US008405556B2

(12) United States Patent
Sung et al.

(10) Patent No.: US 8,405,556 B2
(45) Date of Patent: Mar. 26, 2013

(54) BUILT-IN ANTENNA FOR GLOBAL POSITIONING SYSTEM IN A PORTABLE TERMINAL

(75) Inventors: Sang-Bong Sung, Gyeonggi-do (KR); Kong-Min Sa, Gyeongbuk (KR); Kyung-Jong Lee, Gyeonggi-do (KR); Dong-Hwan Kim, Gyeonggi-do (KR); Jae-Ho Lee, Yongin-si (KR); Byung-Chan Jang, Gyeongbuk (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 370 days.

(21) Appl. No.: 12/802,592

(22) Filed: Jun. 9, 2010

(65) Prior Publication Data

US 2010/0309064 A1 Dec. 9, 2010

(30) Foreign Application Priority Data

Jun. 9, 2009 (KR) ..... 10-2009-0050970

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846, 848
See application file for complete search history.

(56) References Cited

U.S. PATENT DOCUMENTS

| | | | | |
|---|---|---|---|---|
| 6,535,170 | B2 * | 3/2003 | Sawamura et al. | 343/702 |
| 6,876,329 | B2 * | 4/2005 | Milosavljevic | 343/700 MS |
| 6,985,108 | B2 * | 1/2006 | Mikkola et al. | 343/700 MS |
| 7,106,257 | B2 * | 9/2006 | Liu et al. | 343/700 MS |
| 2007/0001913 | A1 * | 1/2007 | Tsai et al. | 343/702 |

* cited by examiner

*Primary Examiner* — Hoang V Nguyen
(74) *Attorney, Agent, or Firm* — Cha & Reiter, LLC

(57) ABSTRACT

A built-in antenna apparatus for a Global Positioning System (GPS) of a portable terminal is provided. The apparatus includes a case frame for forming an exterior of the terminal, a main board fastened by the case frame and having a feeding portion and a ground portion of an antenna radiator, and an antenna radiator having a feeding point and ground point to be electrically connected to the feeding portion and ground portion of the main board, and is curved in a horizontal direction and a vertical direction of the terminal about a center of one upper-side corner of the terminal.

20 Claims, 5 Drawing Sheets
(2 of 5 Drawing Sheet(s) Filed in Color)

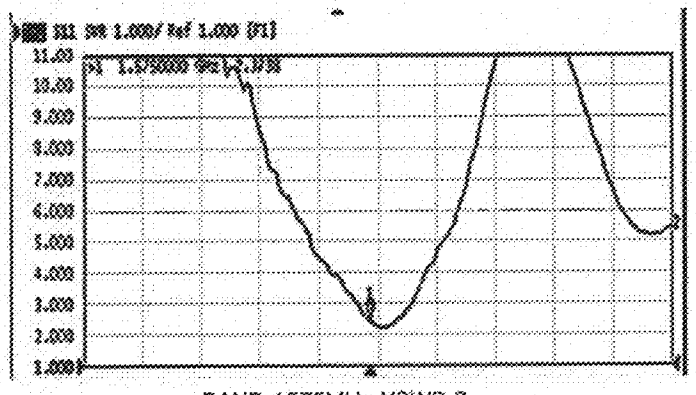
1 : GPS
BAND 1575MHz YSWR 2
FIG.4A
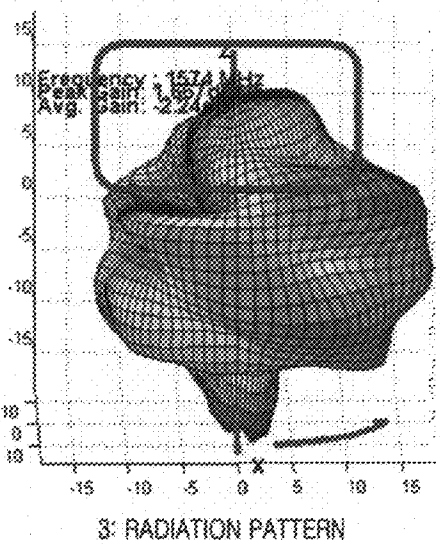
3: RADIATION PATTERN
FIG.4C
| Airlink 3D Antenna Measurement Results | | | | |
|---|---|---|---|---|
| Model Name:File Name | | | Memo:Sample Version | |
| Frequency | Eff. (%) | Ave.Gain (dB/) | Peak Gain (dB/) | Directivity (dB/) |
| 1574MHz | 60 | 2.24 | 1.67 | 3.91 |
| 1574MHz | 60 | 2.25 | 1.67 | 3.92 |
| 1575MHz | 59 | 2.28 | 1.64 | 3.92 |
| 1575MHz | 60 | 2.24 | 1.70 | 3.94 |
| 1578MHz | 59 | 2.28 | 1.56 | 3.94 |
| 1576MHz | 59 | 2.27 | 1.67 | 3.94 |
2 : GPS BAND 1575MHz ANTENNA EFFICIENCY 60%
FIG.4B

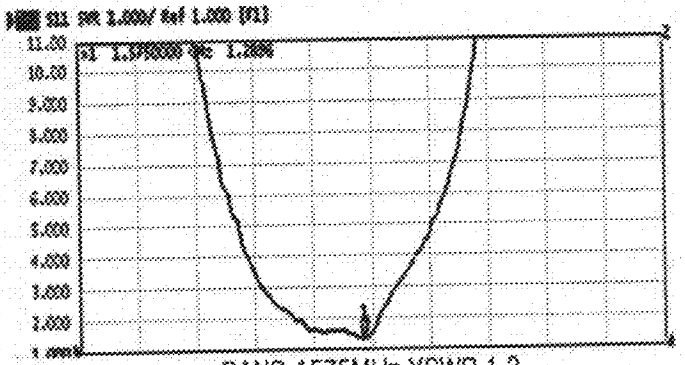
BAND 1575MHz YSWR 1.3
FIG.5A
| Airlink 3D Antenna Measurement Results | | | | |
|---|---|---|---|---|
| Model Name-File Name | | | Memo-Sample Version | |
| Frequency | Eff. (%) | Ave.Gain (dB/) | Peak Gain (dB/) | Directivity (dB/) |
| 1574MHz | 81 | 0.94 | 2.14 | 3.08 |
| 1574MHz | 81 | 0.94 | 2.14 | 3.08 |
| 1575MHz | 81 | 0.94 | 2.18 | 3.11 |
| 1575MHz | 82 | 0.88 | 2.22 | 3.10 |
| 1576MHz | 82 | 0.87 | 2.27 | 3.14 |
| 1576MHz | 82 | 0.87 | 2.27 | 3.14 |
2 : GPS BAND 1575MHz ANTENNA EFFICIENCY 80%
FIG.5B
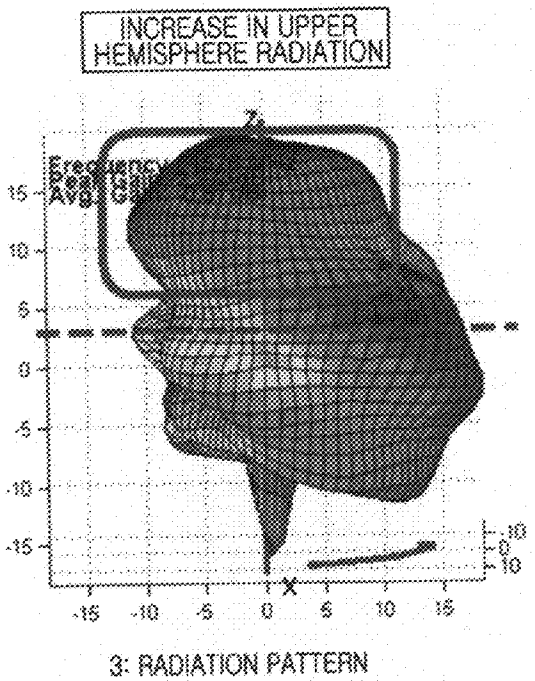
FIG.5C

BUILT-IN ANTENNA FOR GLOBAL POSITIONING SYSTEM IN A PORTABLE TERMINAL

CLAIM OF PRIORITY

This application claims the benefit of priority, under 35 U.S.C. §119(a), of that Korean patent application filed in the Korean Intellectual Property Office on Jun. 9, 2009 and assigned Serial No. 10-2009-0050970, the entire disclosure of which is hereby incorporated by reference in its entirety.

BACKGROUND OF THE INVENTION

1. Field of the Invention

The present invention relates to a built-in antenna apparatus for a portable terminal. More particularly, the present invention relates to a portable terminal with a built-in antenna having a Global Positioning System (GPS) capable of increasing an upper hemisphere radiation to improve the reception.

2. Description of the Related Art

Recently, an antenna of a portable terminal is changing from an externally protruding helical antenna (or whip antenna) to a built-in antenna that is equipped internally in the terminal. This is because the externally protruding antenna apparatus is not esthetic and susceptible to damages caused by frequent impacts.

In a typical built-in antenna apparatus, there is an antenna radiator having a specific pattern and mounted on a main board of the terminal. Just about all manufacturers of the terminal are competing to improve radiation performance while focusing on a slimmer, thinner, and lighter terminal.

The aforementioned built-in antenna apparatus is classified according to the frequency band used by the terminal. Examples of the antenna include a monopole antenna, a Planar Inverted F Antenna (PIFA), etc.

The monopole antenna has only a feeding portion for supplying power to a signal line of a main board. The PIFA has the same arrangement but also has a ground portion that is grounded to a ground member of the main board. The PIFA is more widely used and may also be used by forming a Dual Terminal Antenna (DTA) type pattern depending on various bands used by the terminal.

The PIFA improves a Specific Absorption Rate (SAR) property by attenuating a beam directed towards a ground surface which is re-extracted and directed towards a human body. Further, the PIFA has a directivity property that enforces a beam extracted towards the radiation portion. Moreover, the PIFA operates as a micro strip antenna in which a length of a plate-type radiation portion is decreased. Therefore, there is an advantage in that a low profile structure can be realized.

Meanwhile, in recent years, a Global Positioning System (GPS) is readily provided in a terminal, and thus the terminal must be equipped with an antenna radiator for the GPS application. The GPS antenna radiator may be formed integrally when forming a main antenna radiator for communication. The GPS antenna radiator is generally mounted on a main board of the terminal independently from the main antenna radiator. In general, a PIFA type GPS antenna radiator or a chip antenna radiator is mounted.

However, the aforementioned conventional antenna radiator type is dependent on a surrounding ground (i.e., a ground member), thus an electric field direction of the radiator is directed towards the ground. As the electric field direction of the terminal is directed upwards more in operation, the conventional GPS antenna radiator fails to perform efficiently. A chip antenna, which shows relatively high efficiency, can be used but not economical.

SUMMARY OF THE INVENTION

An exemplary aspect of the present invention is to solve at least the above-mentioned problems and/or disadvantages and to provide at least the advantages described below. Accordingly, an aspect of the present invention is to provide a built-in antenna for a Global Positioning System (GPS) of a portable terminal which is implemented to maximize efficiency of a GPS antenna radiator by increasing an upper hemisphere radiation.

Another exemplary aspect of the present invention is to provide a built-in antenna apparatus for a GPS of a portable terminal which is implemented to be able to obtain an optimal radiation effect at a relatively lost cost when the antenna apparatus is configured.

Another exemplary aspect of the present invention is to provide a built-in antenna apparatus for a GPS of a portable terminal which is implemented to be able to increase an Upper Hemisphere Isotropic Sensitivity (UHIS) through implementation not sensitive to a surrounding ground.

Another exemplary aspect of the present invention is to provide a built-in antenna apparatus for a GPS of a portable terminal which is implemented to be able to contribute to obtain a slim terminal while implementing a GPS antenna having high efficiency.

In accordance with an exemplary aspect of the present invention, a built-in antenna apparatus for a GPS of a portable terminal includes a case frame for forming an exterior of the terminal, a main board fastened by the case frame and having a feeding portion and a ground portion of an antenna radiator for the GPS, and the antenna radiator having a feeding point and ground point to be electrically coupled to the feeding portion and ground portion of the main board. The antenna is curved in a horizontal direction and a vertical direction of the terminal about a center of one upper-side corner of the terminal.

BRIEF DESCRIPTION OF THE DRAWINGS

The patent or application file contains at least one drawing executed in color. Copies of this patent or patent application publication with color drawings will be provided by the U.S. Patent and Trademark Office upon request and payment of the necessary fee.

The above and other aspects, features and advantages of certain exemplary embodiments of the present invention will be more apparent from the following detailed description taken in conjunction with the accompanying drawings, in which:

FIGS. 4A, 4B and 4C illustrate a relationship between a radiation efficiency and an upper hemisphere radiation with respect to the conventional GPS antenna apparatus.

FIGS. 5A, 5B and 5C illustrate a relationship between a radiation efficiency and an upper hemisphere radiation with respect to the inventive GPS antenna apparatus according to the present invention.

DETAILED DESCRIPTION

The following description, with reference to the accompanying drawings, is provided to assist in a comprehensive understanding of certain exemplary embodiments of the invention provided herein for illustrative purposes. The description includes various specific details to assist a person of ordinary skill the art with understanding the claimed invention, but these details are to be regarded as merely exemplary. Accordingly, those of ordinary skill in the art will recognize that various changes and modifications of the illustrative examples described herein can be made without departing from the spirit of the invention and the scope of the appended claims. Also, descriptions of well-known functions and constructions may be omitted for clarity and conciseness when their inclusion may obscure appreciation of the subject matter of the claimed invention by a person or ordinary skill in the art.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural references unless the context clearly dictates otherwise. Thus, for example, a reference to "a component surface" includes reference to one or more of such surfaces.

By the term "substantially" it is typically meant that the recited characteristic, parameter, or value need not be achieved exactly, but that deviations or variations, including but in no way limited to, for example, tolerances, measurement error, measurement accuracy limitations and other factors known to persons of ordinary skill in the art, may occur in amounts that do not preclude the effect the characteristic was intended to provide.

Figure 1:
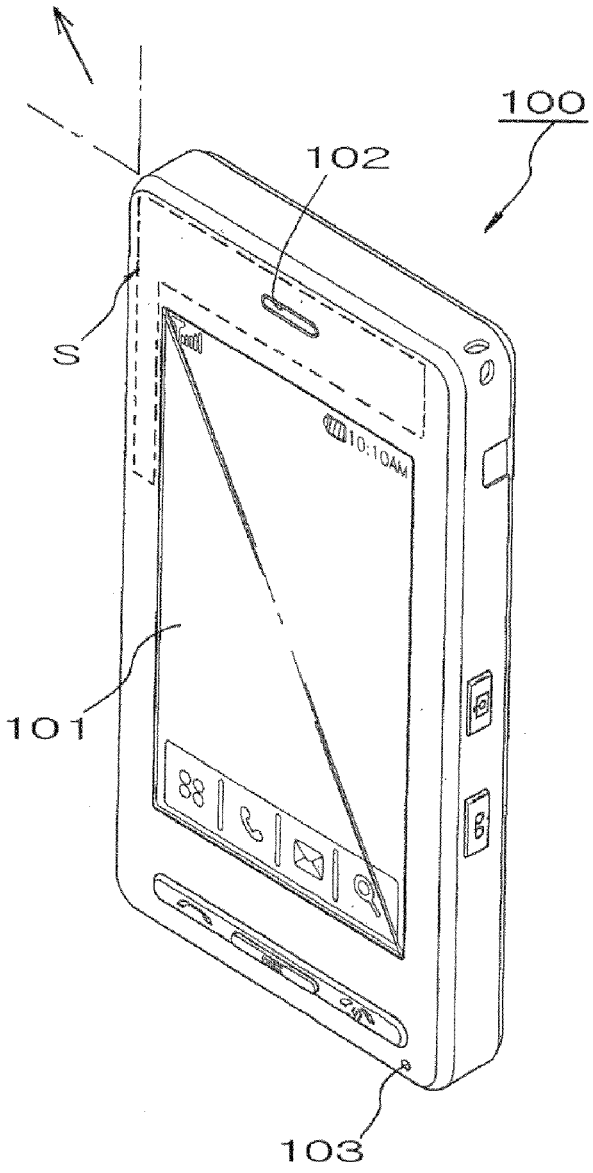
FIG. 1 is a perspective view of a portable terminal having an antenna apparatus for a Global Positioning System (GPS) according to an exemplary embodiment of the present invention.

FIG. 1 is a perspective view of a portable terminal 100 having an antenna apparatus S for a Global Positioning System (GPS) according to an exemplary embodiment of the present invention. The portable terminal 100 is a bar-type terminal and includes a display unit 101 installed in a front portion thereof, an ear piece 102 installed in an upper portion of the display unit 101, and a microphone unit 103 installed in a lower portion of the display unit 101.

The GPS antenna apparatus S is preferably installed in an upper portion of the terminal 100. More preferably, an antenna radiator of the antenna apparatus S is installed by being curved in an L shape in widthwise and lengthwise directions of the terminal. As shown, the GPS antenna apparatus S is installed or formed by being curved along a horizontal direction and a vertical direction. As it will described later, the antenna radiator having such a shape can aid in forming a maximum electric field direction in an arrow direction of FIG. 1, that is, a tangential vector direction of the electric field direction according to a lengthwise radiation element and a widthwise radiation element of the terminal.

Although not shown, in a case where the antenna apparatus S is installed in a slide-type terminal, the antenna apparatus S may be installed in a highest position of the terminal, that is, an uppermost portion of a slide body when the slide body is open.

Further, in a case where the antenna apparatus S is installed in a folder-type terminal, the antenna apparatus S is preferably installed in a highest position of the terminal, that is, an uppermost portion of a folder when the folder is open.

That is, even if teachings of the present invention are applied to other various terminals, the GPS antenna apparatus S is preferably located at an uppermost portion of the terminal is curved in an L shape.

Figure 2:
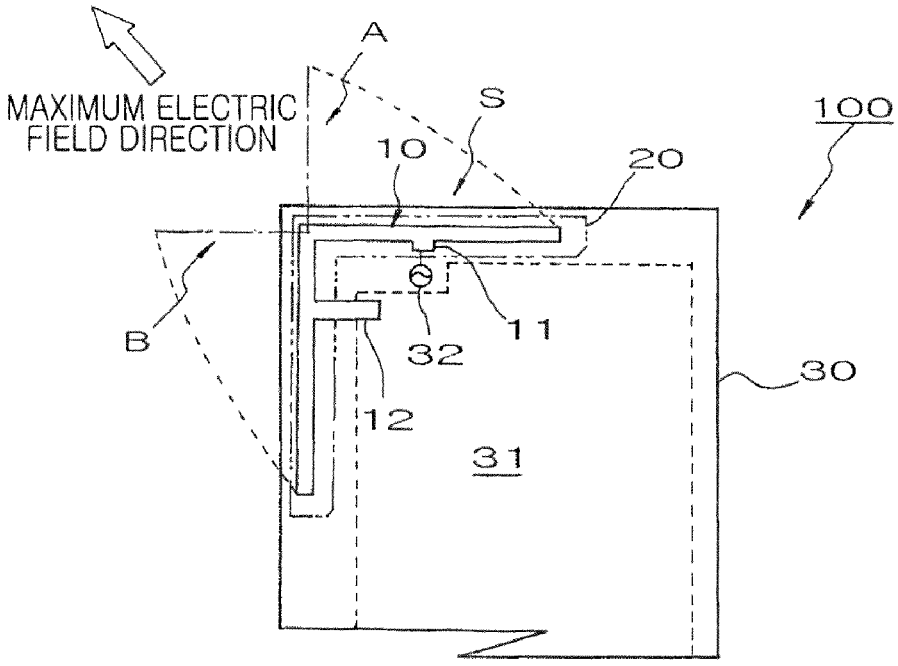
FIG. 2 illustrates a structure of a terminal of a GPS antenna apparatus according to an exemplary embodiment of the present invention.

FIG. 2 illustrates a structure of a terminal of a GPS antenna apparatus S according to an exemplary embodiment of the present invention. More specifically, FIG. 2 illustrates the GPS antenna apparatus S installed or formed on a main board 30 of the terminal.

Referring to FIG. 2, an L-shaped antenna radiator 10 is installed or formed on the main board 30 of the terminal. In this case, the antenna radiator 10 is installed in an uppermost corner of the main board 30, and is formed in widthwise and lengthwise directions of the main board 30. Preferably, the antenna radiator 10 is formed in a right angle when implemented. Such a configuration has a pattern in which a monopole antenna radiator (an upper portion of the antenna radiator) and a PIFA (a lateral portion of the antenna radiator) are combined, thus forming a PIFA pattern in overall. Preferably, the antenna radiator is curved at a right angle, and each of widthwise and lengthwise radiation parts of the terminal has a $\lambda/4$ length with respect to a curved point.

The antenna radiator 10 may have a feeding point 11 in a widthwise direction of the main board 30 and may have a ground point 12 in a lengthwise direction of the main board 30. Therefore, the feeding point 11 can be electrically connected to a signal line 32 of the main board 30, and the ground point 12 can be electrically connected to a ground portion 31 of the main board 30.

In the above arrangement, a portion A corresponds to a maximum widthwise electric field of the antenna radiator 10, and a portion B corresponds to a lengthwise maximum electric field of the antenna radiator 10. As a result, the maximum electric field direction of the antenna radiator 10 is directed in an arrow direction, i.e., an extended direction of a tangential vector of the portions A and B. Therefore, the electric field direction is induced in an optimal direction of the terminal.

Meanwhile, as illustrated in FIG. 2, if there is an enough space to install the antenna radiator 10, an additional carrier 20 can be placed in the main board 30, and the antenna radiator 10 can be attached to an upper surface of the carrier 20. Preferably, when the antenna radiator 10 is the PIFA, the additional carrier 20 may provide a long distance between the antenna radiator and the ground portion 31 of the main board 30 so that the radiation efficiency may be improved. Hence, the additional carrier 20 is to make the distance between the antenna radiator and the ground portion 31 of the main board 30 longer.

Figure 3:
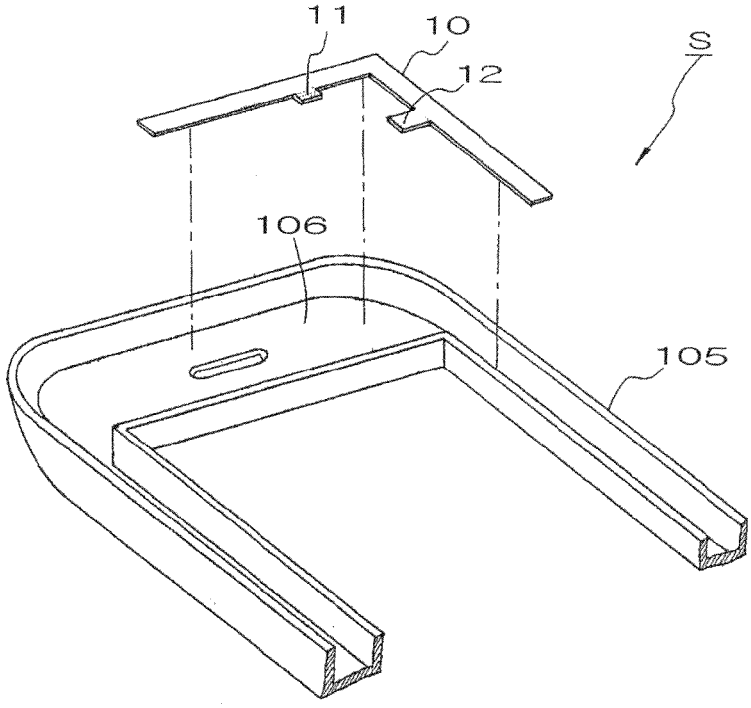
FIG. 3 is a perspective view illustrating major elements when a GPS antenna radiator is installed inside a case frame of a terminal according to another exemplary embodiment of the present invention.

FIG. 3 is a perspective view illustrating components when an antenna radiator 10 for a GPS is installed inside a case frame of a terminal according to another exemplary embodiment of the present invention. Herein, the antenna radiator 10 is not attached to a main board 30, and is attached to an inner surface of a case frame 105 of a terminal 100. In this arrangement, since the antenna radiator 10 is attached to an inner surface 106 of the case frame 105, a space increased by excluding the antenna radiator 10 can be utilized as a space for mounting constitutional elements on the main board, or a smaller and slimmer terminal can be obtained as a size of the main board decreases.

According to the teachings of the present invention, the antenna radiator 10 can be implemented in various manners. For example, the antenna radiator 10 may be a Flexible Printed Circuit (FPC) including the pattern shown in FIG. 2 or may be a metal plate on which a pattern is formed. If the antenna radiator is the FPC or the metal plate, the antenna radiator may be attached to an inner surface of the case frame of the terminal in a bonding manner. In addition, the antenna radiator 10 may be a conductive spray. When the conductive spray is used, it may be coated in a specific pattern on the main board or an inner surface of the terminal case frame. When the antenna radiator 10 is attached to the main board, it may be formed together when a circuit pattern is formed in the main board.

FIGS. 4A, 4B and 4C illustrate a relationship between a radiation efficiency and an upper hemisphere radiation with respect to the conventional GPS antenna apparatus.

FIGS. 5A, 5B and 5C illustrate a relationship between a radiation efficiency and an upper hemisphere radiation with respect to the inventive GPS antenna apparatus according to the present invention.

In both FIGS. 4A, 4B and 4C and FIGS. 5A, 5B and 5C, measurement is performed at a GPS band 1575 MHz. The measurement result shows that the inventive antenna apparatus has a higher efficiency than the conventional antenna apparatus by about 20% or more, that is, the efficiency is increased from 60% to 80% approximately. In addition, as to a Voltage Standing Wave Ratio (VSWR), the inventive antenna radiator has a more wideband property. In addition, as to a radiation pattern, an upper hemisphere radiation of the inventive antenna apparatus is significantly higher than that of the conventional antenna apparatus, and the increment is as significant as it is recognizable by the naked eye.

Having thus described as above, it should be apparent to those skilled in the art that certain advantages have been achieved according to exemplary embodiments of the present invention, where a GPS antenna apparatus can achieve an excellent upper hemisphere radiation and high radiation efficiency in comparison with the conventional antenna apparatus.

While the present invention has been shown and described with reference to certain exemplary embodiments thereof, it will be understood by those skilled in the art that various changes in form and details may be made therein without departing from the spirit and scope of the present invention as defined by the appended claims and their equivalents. Therefore, the scope of the invention is defined not by the detailed description of the invention but by the appended claims and their equivalents, and all differences within the scope will be construed as being included in the present invention.

What is claimed is:

1. A built-in antenna apparatus for a portable terminal, comprising:

a case frame for forming an exterior of the terminal;

a main board fastened to the case frame; and an antenna radiator having a feeding point and a ground point to be electrically coupled to the main board and disposed at an upper corner of the terminal in a horizontal and vertical orientation;

wherein the antenna radiator is bent at a right angle, and each of widthwise and lengthwise radiation parts of the antenna radiator has a $\lambda/4$ length with respect to a point of the bend.

2. The apparatus of claim 1, wherein the feeding point of the antenna radiator is formed in a widthwise direction of the terminal and the ground point is formed in a lengthwise direction of the terminal so as to be electrically coupled respectively to a feeding portion and a ground portion of the main board.

3. The apparatus of claim 2, wherein the antenna radiator is installed or formed on a surface near the upper corner of the main board.

4. The apparatus of claim 3, wherein the antenna radiator is either a Flexible Printed Circuit (FPC) having a radiation pattern and attached on the main board or a metal plate having a radiation pattern and attached on the main board.

5. The apparatus of claim 3, wherein the antenna radiator is formed when the pattern of the main board is formed, or is a conductive spray coated in a pattern shape on an upper surface of the main board.

6. The apparatus of claim 3, wherein the antenna radiator is attached to an upper surface of an antenna carrier having a specific height and installed in the upper corner of the main board.

7. The apparatus of claim 2, wherein the antenna radiator is installed or formed on an inner surface near the upper corner of the case frame.

8. The apparatus of claim 7, wherein the antenna radiator is either an FPC having a radiation pattern and attached on an inner surface of the case frame or a metal plate having a radiation pattern and attached on an inner surface of the case frame.

9. The apparatus of claim 7, wherein the antenna radiator is a conductive spray coated in a pattern shape on an inner surface of the case frame.

10. A portable terminal having a built-in antenna comprising:

a case frame for forming an exterior of the terminal;

a main board fastened to the case frame; and an antenna radiator having a feeding point and a ground point to be electrically coupled to the main board and disposed at an upper corner of the terminal in a horizontal and vertical orientation;

wherein the antenna radiator is bent at a right angle, and each of widthwise and lengthwise radiation parts of the antenna radiator has a $\lambda/4$ length with respect to a point of the bend.

11. The portable terminal of claim 10, wherein the feeding point of the antenna radiator is formed in a widthwise direction of the terminal and the ground point is formed in a lengthwise direction of the terminal so as to be electrically coupled respectively to a feeding portion and a ground portion of the main board.

12. The portable terminal of claim 11, wherein the antenna radiator is installed or formed on a surface near the upper corner of the main board.

13. The portable terminal of claim 12, wherein the antenna radiator is either a Flexible Printed Circuit (FPC) having a radiation pattern and attached on the main board or a metal plate having a radiation pattern and attached on the main board.

14. The portable terminal 12, wherein the antenna radiator is formed when the pattern of the main board is formed, or is a conductive spray coated in a pattern shape on an upper surface of the main board.

15. The portable terminal of claim 12, wherein the antenna radiator is attached to an upper surface of an antenna carrier having a specific height and installed in the upper corner of the main board.

16. The portable terminal of claim 11, wherein the antenna radiator is installed or formed on an inner surface near the upper corner of the case frame.

17. The portable terminal of claim 16, wherein the antenna radiator is either an FPC having a radiation pattern and attached on an inner surface of the case frame or a metal plate having a radiation pattern and attached on an inner surface of the case frame.

18. The portable terminal of claim 16, wherein the antenna radiator is a conductive spray coated in a pattern shape on an inner surface of the case frame.

19. A built-in antenna apparatus for a portable terminal, comprising:

a main board; and an antenna radiator having lengthwise and widthwise parts each in the form of strips, and which extend from a common area in an upper corner of the terminal at a right angle to one another;

wherein one of the lengthwise and widthwise radiation parts has a feeding point at a central region thereof connecting to a feeding portion of the main board, and the other of the lengthwise and widthwise radiation parts has a stub at a central region thereof connecting to a ground surface within the terminal.

20. The antenna apparatus of claim 19, wherein the widthwise radiation part has the feeding point at a central region thereof, the lengthwise radiation part has the stub at a central region thereof, and the antenna apparatus is configured to generate a pattern based on the combination of a monopole radiator in an upper portion of the antenna radiator and a Planar Inverted F Antenna (PIFA) on a lateral portion of the antenna radiator.

* * * * *